US007049970B2

(12) United States Patent
Allen et al.

(10) Patent No.: US 7,049,970 B2
(45) Date of Patent: May 23, 2006

(54) TAMPER SENSING METHOD AND APPARATUS

(75) Inventors: Jonathan Michael Allen, Rochester, MN (US); Matthew Allen Butterbaugh, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 214 days.

(21) Appl. No.: 10/691,291

(22) Filed: Oct. 22, 2003

(65) Prior Publication Data

US 2005/0088303 A1 Apr. 28, 2005

(51) Int. Cl.
*G08B 17/02* (2006.01)

(52) U.S. Cl. ..... 340/590; 340/568.2

(58) Field of Classification Search ..... 340/590, 340/539.31, 568.2, 653, 652, 650, 870.02, 340/870.09

See application file for complete search history.

(56) References Cited

U.S. PATENT DOCUMENTS 4,945,341 A * 7/1990 Buttimer ..... 340/568.3
5,621,387 A * 4/1997 Phillips et al. ..... 340/545.6
5,656,866 A * 8/1997 Conrow ..... 307/10.3
6,087,939 A * 7/2000 Leyden et al. ..... 340/568.2
6,512,454 B1 * 1/2003 Miglioli et al. ..... 340/541
6,693,521 B1 * 2/2004 Lorenz et al. ..... 340/436
6,774,807 B1 * 8/2004 Lehfeldt et al. ..... 340/686.1

* cited by examiner

*Primary Examiner*—John Tweel, Jr.
(74) *Attorney, Agent, or Firm*—Robert W. Lahtinen

(57) ABSTRACT

A tamper sensing circuit is provided for an electrical device wherein an enclosure may be opened to access data by a user that does not possess the ability to achieve normal access by satisfying data security measures such as use of a password. A screw used to secure enclosure halves together is connected by a conductive coating at the enclosure member surface into which the screw is threaded to connect a tamper sensing circuit to the device ground potential. A tamper sensing circuit output node is maintained at the circuit ground potential as long as the screw is in electrical contact with the enclosure conductive coating. When the screw is disengaged from the enclosure member threaded opening, the output node is no longer grounded and rises to a supplied electrical potential indicating tampering and enabling appropriate corrective action. The conductive coating on the enclosure member which connects the screw to circuit ground may be applied or may already be present to suppress electromagnetic interference.

10 Claims, 3 Drawing Sheets

TAMPER SENSING METHOD AND APPARATUS

FIELD OF THE INVENTION

The present invention pertains to security systems and more particularly to the sensing of tampering with respect to devices housed within enclosure members secured together by a connector such as a screw or bolt.

BACKGROUND OF THE INVENTION

The design of data handling devices that may be used for the storage of confidential data will normally require the inclusion of means to detect tampering or the unauthorized disassembly of the device that could be initiated to access the stored confidential data. The smaller the device, the greater the likelihood that it will be lost, mislaid, subject to theft or otherwise be beyond the custody and control of the user and owner of the stored data. In such circumstances, with the device in the possession and control of a party unable to use a password or comply with other requirements to achieve normal access to the stored data, tampering may occur by opening the housing in an attempt to use other extraordinary means to access the data.

In small devices such as a personal digital assistant (PDA) it is important that a non-functional feature incorporated for security purposes not increase the bulk or weight of the device. Ideally the tamper sensing function should be provided, to the extent possible, using structure already incorporated in the device.

In a device which contains confidential data or personal information that would be useful for identity theft, the stored information should be destroyed if the device is disassembled in an attempt to access data which cannot be obtained using the legitimate access to the device.

SUMMARY OF THE INVENTION

The present invention utilizes a central screw which secures the device housing halves together as a portion of a circuit path that maintains an output node of the circuit at a ground potential. When the screw is removed to separate the housing portions and access the enclosed apparatus to obtain data from the device rather than accessing data through normal device operation using a proper password or complying with other security measures, the output node raises to a voltage level that initiates a response to the tampering. This response may be erasure of the memory or mechanical intervention that makes the device and its stored data useless.

The circuit path through the screw or bolt which secures the enclosure portions is effected by a conductor path applied to the housing surface and a compressive connector that connects the housing surface conductor path to the device ground on the printed circuit board. In many environments the enclosure members have a conductive coating applied to the internal surfaces to suppress electromagnetic interference and this provides the conductive path for the tamper sensing circuit. The tamper sensing circuit can thus be implemented using structure already present in most of the devices in which it would find use.

As shown and described, the screw or bolt which interconnects the two device enclosure portions is electrically connected to the device printed circuit board by passing through an opening in the board and engaging a connector element soldered to the board. This connector element is formed as a flat annular member with flexible or resilient fingers that extend radially inward to engage and provide electrically conductive engagement with a screw which extends therethrough and deflects the fingers. The tamper sensing circuit does not have any material effect on the size or weight of the using device and makes use of several structures existing in the device.

DETAILED DESCRIPTION

Figure 1:
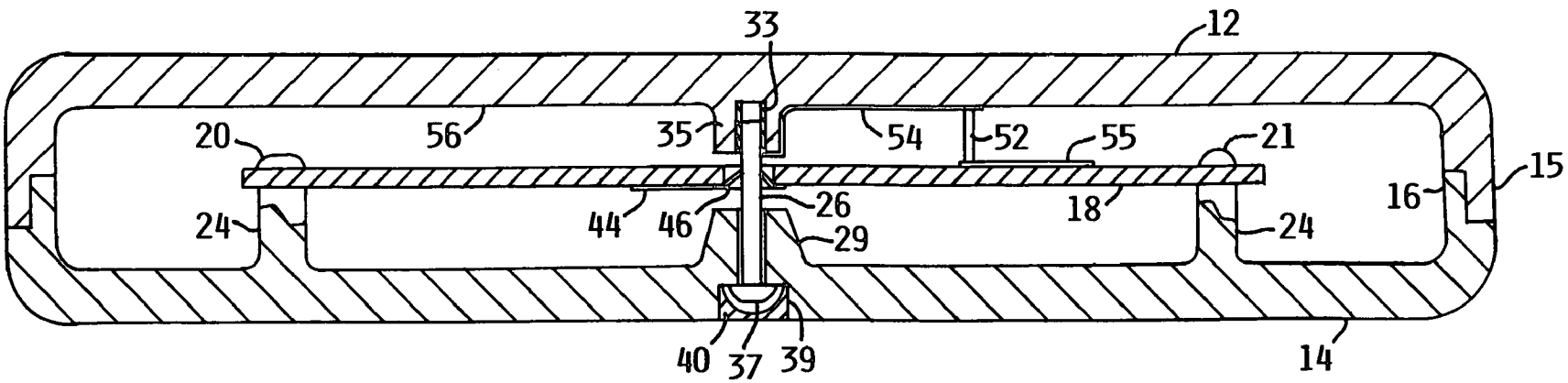
FIG. 1 is a section view of a device incorporating the tamper sensing apparatus and method of the present invention.

FIG. 1 illustrates an electronic device contained within a housing having an upper enclosure member 12 and a lower enclosure member 14 with respective marginal flanges 15 and 16 which align and position the enclosure members in the assembled condition. A printed circuit board 18 is mounted on the lower enclosure member 14 by screws 20 and 21 which extend through holes in the printed circuit board and are received in axial openings in bosses 24 that are formed as an integral part of the lower enclosure member 14.

Figure 2:
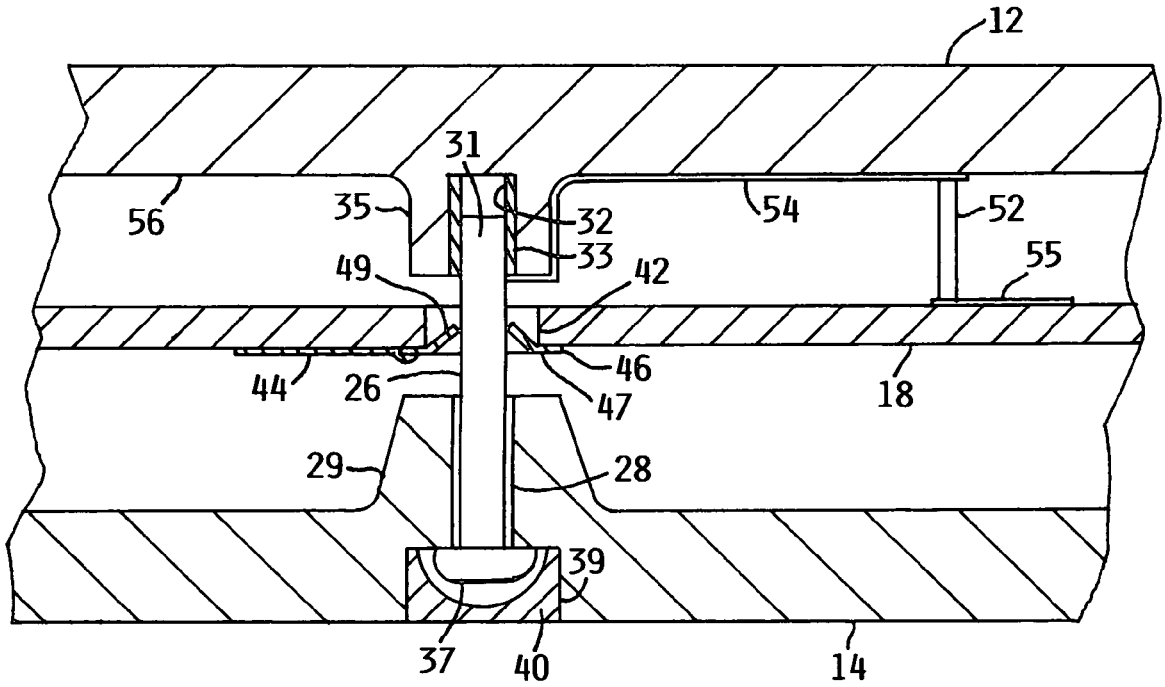
FIG. 2 is an enlarged section view of the central portion of FIG. 1.

FIG. 2 shows an enlarged central portion of the device shown in FIG. 1. The enclosure members 12 and 14 are secured together by a screw 26 which extends through a cylindrical opening 28 in the boss or raised portion 29, formed as an integral portion of the lower enclosure member 14 with the terminal end 31 received in a threaded opening 32 in the upper enclosure member 12. The threaded opening in enclosure member 12 is formed in a cylindrical metal insert 33 that is captured in the molded enclosure member boss 35. In the alternative, the threaded opening could be formed in a cylindrical depression in the boss 35. The screw head 37 is received in a recess 39 in the lower enclosure member 14 and screw head 37 is covered by a cap 40, made of the same material as the enclosure member 14, which enables the lower enclosure member to present an uninterrupted lower surface.

Figure 3:
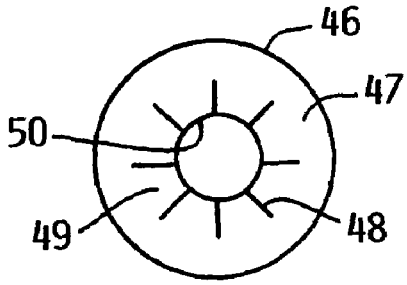
FIG. 3 is a plan view of the resilient metal annular member used to make electrical contact between the screw connecting the enclosure portions and the device circuitry on the printed circuit board.

The screw 26 also passes through a circular opening 42 in the printed circuit board 18. Electrical contact between the screw 26 and a circuit path 44 on printed circuit board 18 is effected by a resilient metal annular member 46. As seen in FIG. 3, the annular member 44 has a continuous outer annulus 47 and a portion radially inward that includes radially extending cuts or separations 48 to form a series of inwardly extending finger portions 49 that can be deflected. As assembled in FIG. 2, the outer annulus 47 of member 46 is soldered to the printed circuit board 18 enabling electrical connection to printed circuit board conductor path 44. The annular member fingers 49 terminate in a circular edge 50 having a diameter smaller than that of screw 26, so that when the screw is inserted through the circular member 46 the fingers 49 are deflected to form an electrical contact between annular member 46 and screw 26.

A compressible conductive part 52 is soldered to the printed circuit board and engages the upper enclosure member conductive layer 54 to provide the conductive layer 54 a connection to the card ground circuit 55. The conductive layer 54 is a circuit path extending between the conductive part 52 and the metal insert 33 to cause the screw 26 to be connected to the card ground circuit when installed to engage the threaded insert and secure the upper enclosure member 12 to the lower enclosure member 14.

Although the conductive layer 54 is shown as a circuit path applied to the upper enclosure member inner surface 56, it is frequently unnecessary to make a special provision for this conductor since it is often necessary to apply a metal coating to such enclosure member inner surface 56 to prevent electromagnetic emissions.

Figure 4:
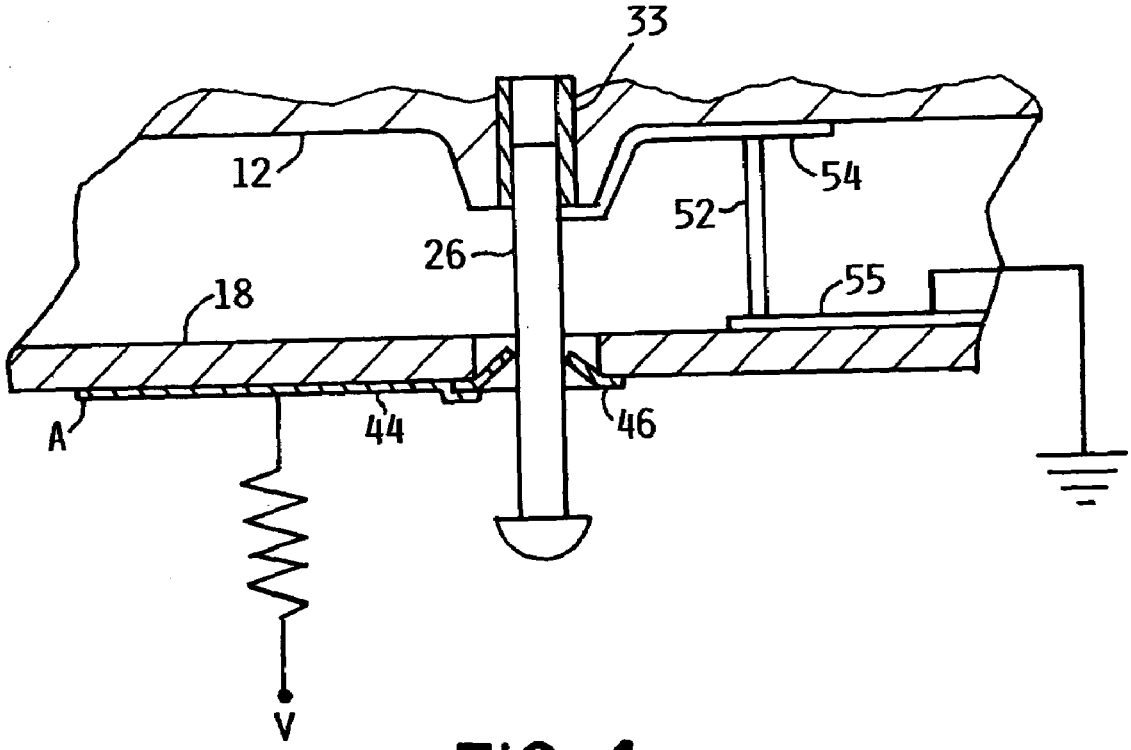
FIG. 4 is a schematic showing of the tamper sensing circuit using the screw connecting the enclosure portions as a part of the circuit.

FIG. 4 illustrates the tamper sensing circuit effected by the enclosure structure shown in FIGS. 1 through 3. The conductive layer 54 is connected through the compressible connector 52 to the card ground 55. The continuous conductive path from the card ground formed by the conductive layer 54, screw 26 (through insert 33), the resilient annular member 46 and printed circuit board circuit path 44; causes node A to be at ground potential. Should the circuit be interrupted by the removal of screw 26, node A would rise to voltage V, indicating the occurrence of tampering and causing the device to respond. Where the security measure is provided to prevent access to confidential data, the device could overwrite the memory or cause hardware damage that would prevent access to stored data.

The length of overlap of the enclosure member marginal flanges 15 and 16 is greater than the length of screw 26 that is received in the enclosure member threaded opening 32. Thus, the screw 26 will disengage from the threaded opening 32 and signal tampering at node A before the enclosure member marginal flanges 15 and 16 cease to overlap. The existence of tampering is thereby signaled prior to access being gained to the interior of the device housing and the device circuitry.

This invention utilizes structure that already exists in the device to perform a large portion of the function. This minimizes the structure that must be added to support the sensing function. Thus, when tamper sensing is required, it can be provided with little or no impact on the device volume, which is highly restricted in most electronic apparatus environments.

The foregoing description of an embodiment of the invention has been presented for purposes of illustration and description. It is not intended to be exhaustive or limit the invention to the precise form disclosed. Many modifications and variations are possible in light of the above teaching. It is intended that the scope of the invention be limited not by the description and illustrations, but rather by the claims appended hereto.

What is claimed is:

1. An apparatus for sensing tampering with an electrical device contained within a housing including first and second enclosure members comprising:

an electrically conductive connector element extending from said first enclosure member and secured to said second enclosure member to secure said enclosure members to one another and to wholly enclose said electrical device;

a tampering sensing circuit including a first conductive path with said electrically conductive connector element as a series element of said first conductive path; and means for sensing when said first conductive path has been interrupted by withdrawal of said electrically conductive connector element indicative of tampering wherein said electrically conductive connector element is a metal screw that is received in a threaded opening in said second enclosure member.

2. The apparatus for sensing tampering of claim 1 wherein said first conductive path is connected to the ground potential of said electrical device and said tamper sensing circuit includes an output node that is maintained at said ground potential of said electrical device when said first conductive path through said screw is electrically connected to said ground potential.

3. The apparatus for sensing tampering of claim 2 wherein said tamper sensing circuit is further connected to a first electrical potential which causes said output node to approach said first electrical potential when the connection of said first conductive path to said ground potential of said electrical device is interrupted by withdrawing said screw.

4. The apparatus for sensing tampering of claim 3 wherein said first and second enclosure members include marginal flanges extending in the direction of the axis of said screw which overlap in the assembled condition to align and position the enclosure members with respect to each other, the overlapping length of said marginal flanges being greater than the distance that said screw is withdrawn prior to interruption of said first conductive path, whereby the connection of said tamper sensing circuit to said electrical device ground potential is interrupted before said first and second enclosure members separate sufficiently to permit access to said electrical device.

5. In an electrical device, including a tamper sensing circuit with an output node, contained within first and second enclosure members which are secured together by a screw which extends from said first enclosure member and engages said second enclosure member, a tamper sensing method comprising:

maintaining said tamper sensing circuit output node at a first electrical potential by connecting said output node to said first electrical potential through a current path extending serially through said screw;

providing a second electrical potential source to said tamper sensing circuit; and establishing said second electrical potential at said tamper sensing circuit output node when said screw is disengaged from said second enclosure member.

6. The tamper sensing method of claim 5 wherein said step of maintaining said tamper sensing circuit output node at a first electrical potential comprises maintaining said node at the circuit ground potential of said electrical device.

7. In an electrical device including first and second enclosure members which surround and enclose the electrical circuitry of said device when secured together by a conductive connector which extends from said first enclosure member and is secured to said second enclosure member, a tamper sensing circuit comprising:

an output node;

a first electrical potential connected to said output node by a circuit extending in series through said conductive connector member when said conductive connector is secured to said second enclosure member and is interrupted when the series connection through said conductive connector is interrupted by disengagement of said conductive connector from said second enclosure member; and a second electrical potential connected to said output node and effective to establish said second electrical potential at said output node when said connection of said first electrical potential to said output node is interrupted by disengagement of said conductive connector from said second enclosure member wherein said conductive connector is a metal screw extending from said first enclosure member and received in a threaded opening in said enclosure member.

8. The electrical device tamper sensing circuit of claim 7 wherein said electrical device electrical circuitry includes a printed circuit (PC) board on which said output node is mounted and an aperture through which said screw passes when extending from said first enclosure member to said second enclosure member and further comprises connector means mounted on said PC board which is connected to said output node and resiliently engages said screw extending through said PC board aperture.

9. The electrical device tamper sensing circuit of claim 8 wherein said first electrical potential is the PC board circuit ground and said tamper sensing circuit further comprises a conductive path secured to the inner surface of said second enclosure member which extends from said threaded opening, where it electrically connects to said screw when such screw is secured in said threaded opening, to a connector element which interconnects said conductive path with the PC board circuit ground.

10. The electrical device tamper sensing circuit of claim 9 further comprising a resilient annular member with a continuous outer portion and radially inwardly extending integral fingers having distal ends defining an opening with a diameter smaller than the diameter of said screw, whereby, with the outer annular portion soldered to said PC board surrounding said aperture, said integral fingers are deflected by and engage said screw when said screw extends through said aperture.

* * * * *